US007526880B2

(12) United States Patent
Polcek

(10) Patent No.: US 7,526,880 B2
(45) Date of Patent: May 5, 2009

(54) CUSHIONED INSOLE

(76) Inventor: Norma Ellen Polcek, 1019 Braeburn La., Rockford, IL (US) 61107

( * ) Notice: Subject to any disclaimer, the term of this patent is extended or adjusted under 35 U.S.C. 154(b) by 158 days.

(21) Appl. No.: 10/914,585

(22) Filed: Aug. 9, 2004

(65) Prior Publication Data

US 2006/0026867 A1 Feb. 9, 2006

(51) Int. Cl.
*A43B 13/38* (2006.01)

(52) U.S. Cl. ..... 36/44; 36/43; 36/107; 36/24.5

(58) Field of Classification Search ..... 36/43, 36/44, 107, 108, 24.5, 76 C, 76 R
See application file for complete search history.

(56) References Cited

U.S. PATENT DOCUMENTS

| | | | | | |
|---|---|---|---|---|---|
| 526,234 | A | | 9/1894 | Kee | |
| 1,273,292 | A | | 7/1918 | Vescio | |
| 1,741,419 | A | * | 12/1929 | Jones | 36/145 |
| 2,055,574 | A | * | 9/1936 | Hartl | 36/44 |
| 2,150,895 | A | | 3/1939 | Leone | |
| 2,207,632 | A | * | 7/1940 | Margolin | 36/3 R |
| 2,209,280 | A | | 7/1940 | Noonan | |
| 2,253,959 | A | * | 8/1941 | Margolin | 36/3 B |
| 2,299,305 | A | | 10/1942 | Ciaio | |
| 2,300,681 | A | * | 11/1942 | Margolin | 36/3 B |
| 2,308,529 | A | * | 1/1943 | Margolin | 36/3 B |
| 2,347,207 | A | * | 4/1944 | Margolin | 36/3 B |
| 2,348,336 | A | | 5/1944 | Everston | |
| 2,377,460 | A | | 6/1945 | Strong | |
| 2,405,224 | A | | 8/1946 | Margolin | |
| 2,414,910 | A | * | 1/1947 | Stritter | 36/30 R |
| 2,437,227 | A | | 3/1948 | Hall | |
| 2,547,480 | A | | 4/1951 | McDaniel | |
| 2,572,670 | A | * | 10/1951 | Schwartz | 36/28 |
| 2,928,193 | A | * | 3/1960 | Kristan | 36/178 |
| 3,412,487 | A | * | 11/1968 | Diamant | 36/44 |
| 4,404,702 | A | * | 9/1983 | Clayman et al. | 12/146 S |
| 4,429,473 | A | | 2/1984 | Blumenstein | |
| 4,942,679 | A | * | 7/1990 | Brandon et al. | 36/102 |
| 5,435,077 | A | | 7/1995 | Pyle | |

FOREIGN PATENT DOCUMENTS

| | | | | |
|---|---|---|---|---|
| JP | 05023203 | A | * | 2/1993 |

* cited by examiner

*Primary Examiner*—Marie Patterson

(57) ABSTRACT

A cushioned insole includes a top cushion, a Texon brand or similar insole support layer, and a cushion insert that establishes a cushioned insole forepart through its entire thickness. The cushioning is established with the cushion insert positioned through an open forepart of the Texon. The cushion insert may either be positioned against the top cushion overlaying the open Texon forepart, or extending through an open forepart of the top cushion.

29 Claims, 5 Drawing Sheets

CUSHIONED INSOLE

CROSS-REFERENCES TO RELATED APPLICATIONS

None

REFERENCE TO SEQUENCE LISTING, TABLE, OR COMPUTER PROGRAM LISTING APPENDIX SUBMITTED ON A COMPACT DISC

N/A.

STATEMENT REGARDING FEDERALLY SPONSORED RESEARCH OR DEVELOPMENT

N/A.

BACKGROUND OF THE INVENTION

1. Field of Invention

This invention relates generally to an insole for shoes.

More specifically, the invention relates to a cushioned insole that is especially adapted for enhanced comfort, is suitable for use, universally, with many types of shoes, and is particularly useful in shoes where a low-profile insole is desired, such as, but not limited to, casual shoes, dress shoes and high heel shoes.

2. Background Art

Dress shoes and evening shoes, such as women's high heel shoes, are often uncomfortable, particularly when worn for long periods of time. This is a result, in part, because the higher the heel, the more pressure from the wearer's weight is concentrated through the ball of the wearer's foot. It is generally believed by those skilled in the art that creating a shoe that is truly comfortable for extended wear with a heel over two inches is next to impossible. With, for example, a two and one-half inch heel, pressure equal to approximately five times the wearer's body weight is experienced through the ball of the wearer's foot, and a three inch heel results in approximately seven times more stress on the forefoot than a one inch heel.

Through the years there have been many attempts to bring enhanced comfort to shoes. For example, prior shoes have used insoles padded with various materials. In many instances, these materials initially have very little or no appreciable cushioning effect. In other instances, after the shoes are worn for a period of time, the insole padding tends to compress due to the weight of the wearer, and the initial softness becomes firm under the wearer's foot. In an alternate approach, the outsoles of some shoes are made from rubber or other material that is softer than conventional leather-type soles. However, such outsoles are rather bulky; it is a style and condition which some people simply do not care for, and such outsoles are generally not suitable for higher fashion shoes such as dress shoes or conventional high heel shoes.

In my recent U.S. patent application Ser. No. 10/743,607, filed on Dec. 22, 2003, I teach a high heel shoe and cushioning system that address the above-noted drawbacks with a uniquely constructed cushioned insole layered on top of a uniquely constructed cushioned midsole to create an interaction of cushioned materials at the forepart of a shoe. The combination divides the pressure created by the foot between the cushion parts so that each component absorbs a portion of the pressure and the combination remains soft and comfortable under the wearer's foot even when the shoe is worn for extended periods of time. This new cushion system provides substantially enhanced comfort in the finished shoes. However, there remains a need for a shoe cushion system that establishes a similarly comfortable shoe, but which is suitable for use in shoes with a lower profile forepart, non-platform configuration, such as is often utilized with casual shoes, dress shoes, fashion high heel shoes, and shoes considered as "flats" or with minimum heels, as well as being suitable for use in other types of shoes.

SUMMARY OF THE INVENTION

The primary object of the invention is to provide a new and improved shoe cushion system that obtains design and comfort advantages over prior shoes.

A detailed objective of the invention is to provide a uniquely constructed cushioned insole that can be configured for use in shoes such as with a conventional outsole to provide the visual appearance of a conventional shoe with a low profile insole/outsole configuration, as well as in other types of shoes, but that includes enhanced cushioning at the forepart of the shoe so that the shoe remains soft and comfortable under the wearer's foot when worn for extended periods of time.

Another detailed objective of the invention is to provide a shoe with a uniquely constructed cushioned insole that achieves enhanced cushioning at the forepart of the shoe so that the shoe remains soft and comfortable under the wearer's foot when worn for extended periods of time.

Yet another objective of the invention is to provide for a method for manufacturing shoes with a uniquely constructed cushioned insole that achieves enhanced cushioning at the forepart of the shoe so that the shoe remains soft and comfortable under the wearer's foot when worn for extended periods of time.

A preferred insole in accordance with the invention includes a Texon brand layer, or similar insole support layer, with a foot-shape outer profile and a substantially open forepart, a top cushion secured over the Texon, and additional cushion material that fills the open forepart of the Texon layer and establishes a cushioned insole forepart through the entire thickness of the top cushion and the Texon layer. Thus, the preferred insole is cushioned through its entire forepart thickness.

A shoe utilizing the cushioned insole is provided with a forepart that is cushioned through its entire thickness between a flexible insole outer wrap or covering, and the outsole or a midsole of the shoe. The insole with additional forepart cushioning can be implemented in many types of shoes, but is particularly useful, and will result in increasingly enhanced advantages, when used in high heel shoes with heels of one inch or greater. A method for manufacturing new shoes includes providing a the cushioned insole with a forepart cushion insert that establishes cushioning through the forepart thickness of the top cushion and the Texon, securing a flexible insole covering over the top cushion, and securing one of an outsole or a midsole to the bottom of the cushioned insole, such that the cushion insert is compressed in fixed relation between the insole covering and the outsole or midsole of the shoe.

In one embodiment, the cushioned insole includes a forepart cutout through the thickness of both the Texon and the top cushion, and the cutout is filled with a cushion insert that is sandwiched in the finished shoe such as between the insole covering and the outsole. The weight of the wearer is transferred through the flexible insole covering to the top cushion, and particularly from the ball of the foot to the cushion insert at the forepart of the shoe. In a second embodiment, a forepart cutout is formed through the Texon layer, the top cushion overlays the Texon layer including the cutout, and the cutout is filled with a cushion insert that is secured in a finished shoe between the top cushion and the outsole or a midsole of the shoe.

The preferred top cushion and cushion insert are made from a natural or synthetic foam rubber material characterized with a compression deflection of approximately 25% with an applied compressive pressure of between approximately 2 to 12 psi. For implementation in a low-profile insole, the top cushion is, when in a relaxed, non-compressed condition, at least approximately ⅛ inch thick, and preferably at least approximately 3/16 inch thick; and the forepart cushioning is, when in a relaxed, non-compressed condition, at least approximately ¼ inch thick, and preferably at least approximately ⅜ inch thick. These preferred material characteristics will result in a finished low-profile insole that is suitable for use in, for example, casual shoes, dress shoes, and fashion high heel shoes, and that will maintain its cushioning characteristic, even when exposed to the high pressures in the forepart of shoes for extended periods of time. Alternate materials and thickness may be provided for the top cushion and cushion insert to establish the noted cushioning effect in the finished insole and shoe.

These and other objectives and advantages of the invention will become more apparent from the following detailed description when taken in conjunction with the accompanying drawings.

Figure 1:
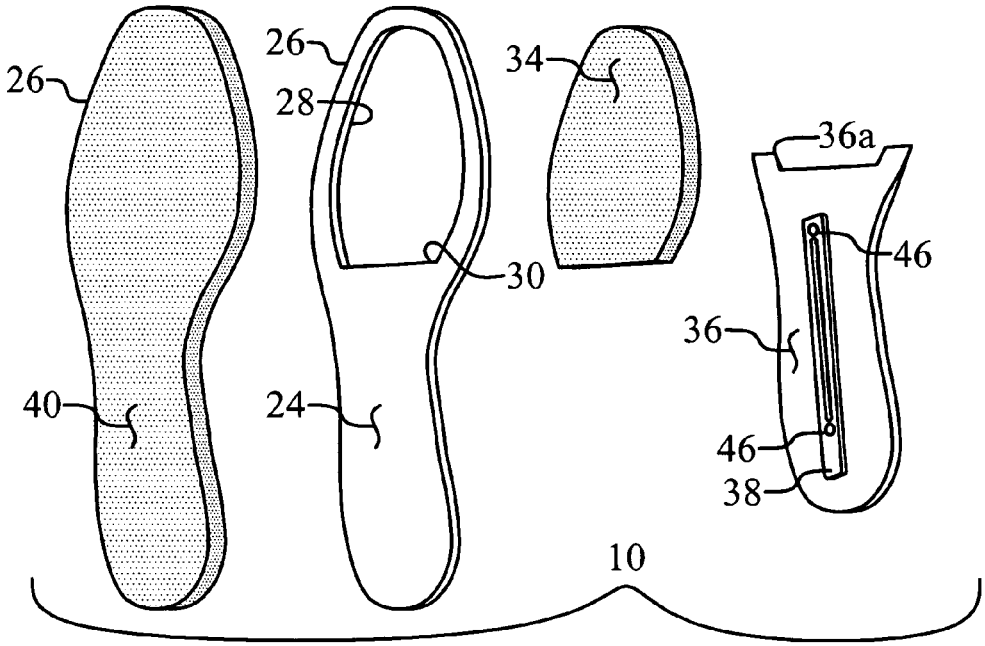
FIG. 1 is an exploded perspective view of a first embodiment cushioned insole incorporating certain unique aspects of the invention.
Figure 2:
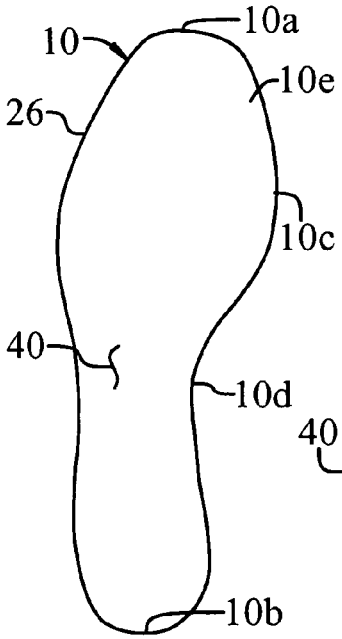
FIG. 2 is a top plan view of the cushioned insole of FIG. 1 as assembled together.
Figure 3:
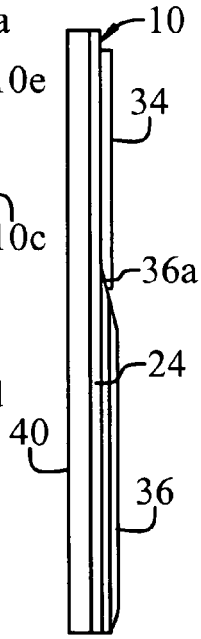
FIG. 3 is a side elevation view of the cushioned insole.
Figure 4:
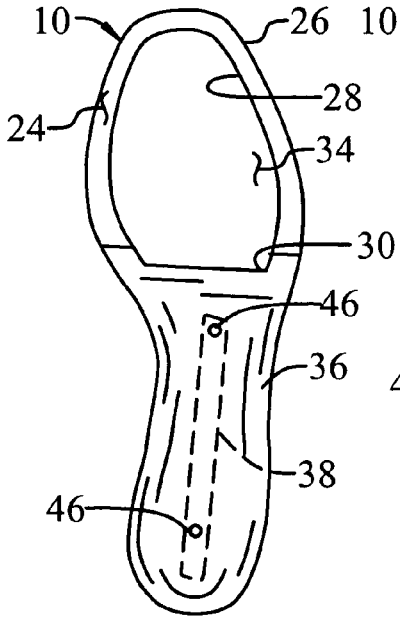
FIG. 4 is a bottom plan view of the cushioned insole.

While the invention is susceptible of various modifications and alternative constructions, certain preferred embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION AND PREFERRED EMBODIMENTS

Figure 7:
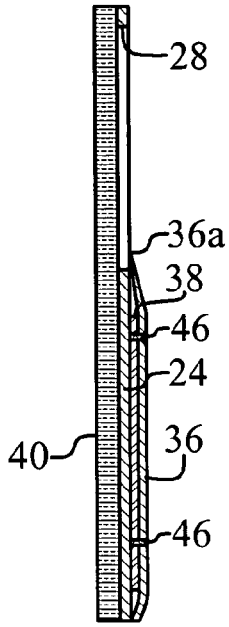
FIG. 7 is a side cross-sectional view similar to FIG. 5 of the cushioned insole but with the cushion insert removed to expose the forepart cutout in the Texon.
Figure 8:
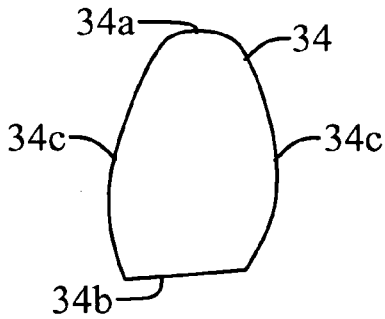
FIG. 8 is a top plan view of the cushion insert.

For purposes of illustration, the present invention is shown in the drawings in connection with a first embodiment cushioned insole 10 shown in FIGS. 1-5. The cushioned insole comprises an insole support layer 24, a top cushion 40 and a cushion insert 34. The insole support layer is made from Texon brand material, or an alternate insole material, and is formed with a foot-shape outer profile 26 that will typically correspond to the desired foot-shape profile of the finished insole and the finished shoe in which the cushioned insole 10 is to be used. The Texon is further provided with a substantially open forepart established with a cutout 28 extending through its entire thickness. The top cushion is provided with the same outer profile 26, and is glued or otherwise secured over the top of the Texon, including over the cutout 28 (see e.g., FIGS. 5, 7). Thus, the cushioned insole is provided with a foot-shape profile when viewed from above (as in FIG. 2) or from below (as in FIG. 4), with a toe end 10*a*, a heel end 10*b*, an outwardly projecting profile 10*c* corresponding to the position of the ball of the foot shape, an arch profile 10*d* corresponding to the position of the arch of the foot shape, and a forepart 10*e* established between the toe end 14*a* and the arch profile 14*d*. The cushion insert is installed into the cutout 28 through the open back side, and is glued to or otherwise positioned in the cutout 28 against the top cushion (see e.g., FIG. 5).

Figure 15:
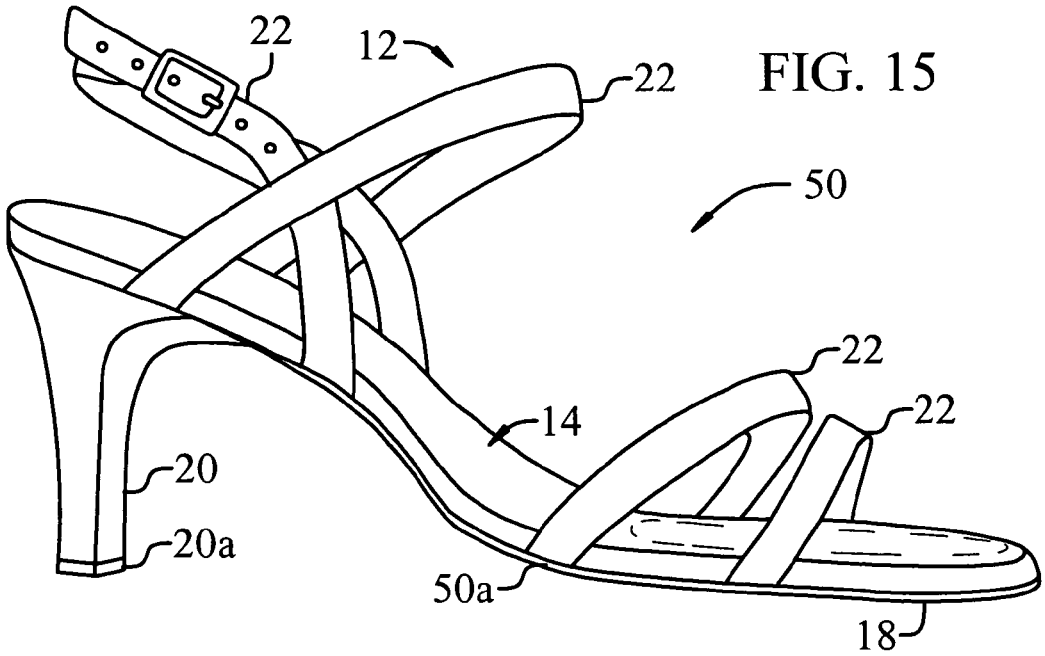
FIG. 15 is a perspective view of a finished shoe utilizing a cushioned insole in accordance herewith.

The cutout 28 is formed with an inside profile generally tracking the forepart of the outer profile 26 to establish a forepart perimeter that at least substantially and preferably completely surrounding the cutout. This perimeter configuration stabilizes the forepart of the Texon during handling and manufacturing processes, and restrains the cushion insert 34 longitudinally and laterally in position in the insole. The back edge 30 of the cutout extends substantially across the width of the Texon, and is located in the arch profile area of the foot-shape, behind where the ball of the wearer's foot will be located in the finished shoe. This location generally designated as 50*a* in the finished shoe shown in FIG. 15 is at approximately where a finished shoe angles from the forepart towards the heel. The cutout 28 is relatively large with respect to the outer profile of the insole to permit use of a large cushion insert 34 support under the forepart of the wearer's foot through which the wearer's weight is applied, particularly when the heel is in a raised position such as while walking in a normal gait or otherwise.

The preferred Texon is cut from a sheet that is at least approximately 3/32 inch thick. Conventional shoe construction often utilizes a Texon sheet with a strip of thin-layer Texon (of approximately 3/64 inch thick) secured along an edge to a strip of thicker Texon (of approximately 3/32 inch thick). The Texon for the shoe is cut from this sheet so that the forepart of the Texon piece is cut from the thin-layer strip while the heel part of the shoe is cut from the thicker Texon. In other words, the cut pattern for the Texon piece used in a typical shoe is established overlapping the junction between the thin-layer Texon and the thicker Texon, with the heel part being cut from the thicker Texon. Insoles in accordance with the invention preferably utilize the thicker Texon material such as described throughout the entire Texon layer. The thicker Texon material contributes to strength and stiffness at the forepart, after the large cutout has been formed, for ease of handling and subsequent manufacturing processes, and enables a larger cutout as compared with establishing the same perimeter strength with the thinner Texon.

Figure 5:
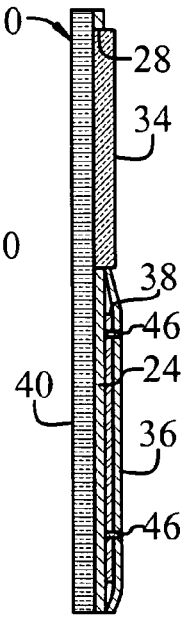
FIG. 5 is a side cross-sectional view of the cushioned insole.
Figure 6:
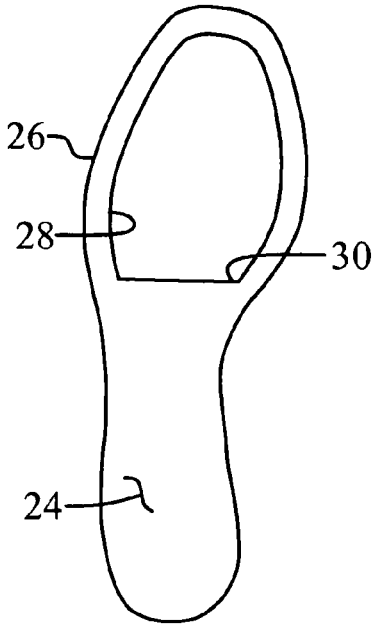
FIG. 6 is a top plan view of the Texon included in the cushioned insole, the bottom view being a mirror image thereof.
Figure 9:
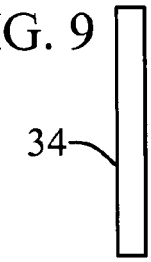
FIG. 9 is a side elevation view of the cushion insert.

The cushion insert 34 is provided with an outer profile that tracks the inside profile of the cutout 28 to fill the cutout. Thus, the cushion insert includes a toe end 34*a*, an arch end 34*b* to be located proximate the arch profile of the insole at end 30 of the cutout, and sides 34*c* that extend from the toe end to the arch end and correspond to the side profile of the cutout. The thickness (FIG. 9) of the cushion insert is established at least equal to the material thickness of the Texon and cutout 28, or otherwise for the finished insole and shoe configuration, to completely fill the cutout in the insole of the finished shoe. As shown in FIG. 5, the thickness of the cushion insert is preferably established at the material thickness of the Texon plus an additional thickness such that the cushion insert "over-fills" the thickness of the cutout at least when the cushion materials are in a relaxed condition.

In preferred embodiments, the top cushion 40 and cushion insert 34 are a natural or synthetic rubber foam cushion material characterized with a compression deflection of approximately 25% with a compressive applied pressure of between approximately 2 to 12 psi, and are, when in a relaxed, non-compressed condition, at least approximately 1/8 inch thick, and preferably approximately 3/16 inch thick. The resulting total forepart cushion thickness of the insole, when in a relaxed, non-compressed condition, of between approximately 1/4 to 3/8 inch thick is suitable for use in many types of shoes, including shoes with low-profile configuration finished insoles such as casual shoes, dress shoes and high heel shoes. Suitable foam rubber cushion materials include, but are not limited to EPDM, neoprene polyurethane or other synthetic or natural open-cell or closed-cell materials. Alternate cushion inserts 34 may be provided such as, but not limited to, an air-bubble or "air" cushion, or gel-type cushions, preferably with the above-noted cushioning characteristics.

A shoe tuck 36 and shank 38 are glued or otherwise secured to the bottom side of the Texon. The tuck and shank shown are of conventional construction, and are secured together such as with rivets 46. The tuck is typically made from relatively stiff sheet material, sized to extend from the heel end of the insole to proximate the arch profile, and the shank is typically made from a metal or rigid plastic strip. In general, the tuck and shank are of rigid construction to provide structural support to the portion of the shoe between the forepart and the heel end of the shoe. The arch profile end 36*a* of the preferred tuck is thinned or narrowed for a smooth transition on the bottom of the cushioned insole, and in the finished insole and shoe.

Figure 10:
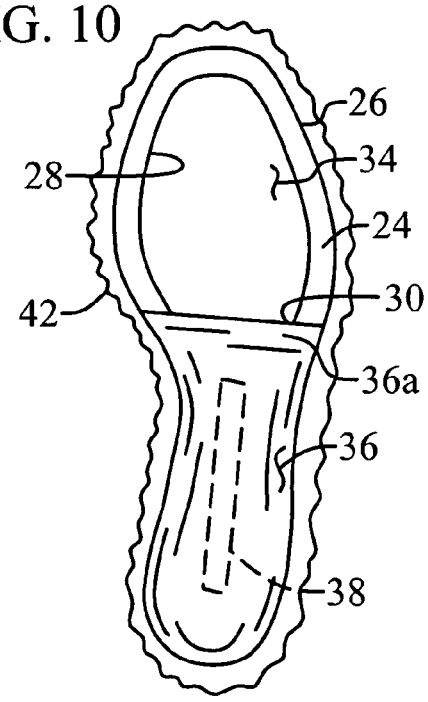
FIG. 10 is a bottom plan view of the cushioned insole resting on an insole covering that is shown laid flat.
Figure 11:
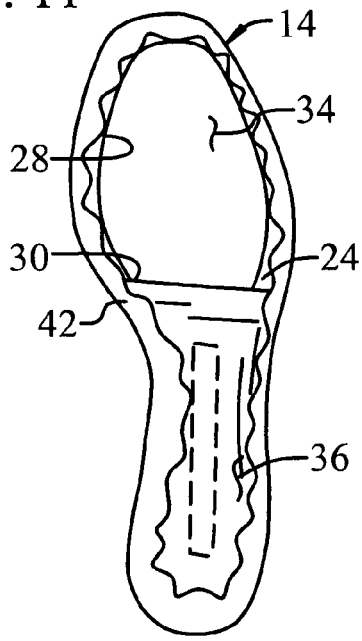
FIG. 11 is a bottom plan view similar to FIG. 10 but showing the insole covering wrapped around the cushioned insole.
Figure 12:
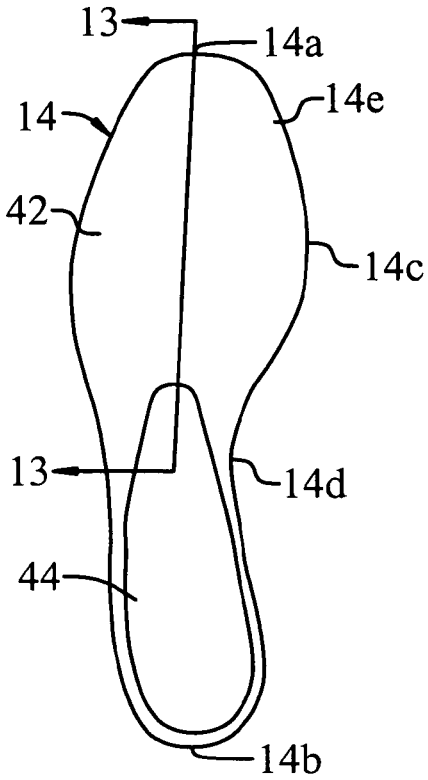
FIG. 12 is a top plan view of the finished insole, with a heel seat secured in position to the heel end of the insole covering.

In the implementation shown in FIGS. 10-15, the cushioned insole 10 is utilized in a finished insole 14 for a high heel shoe 50 with an upper 12, an outsole 18 and a high heel 20. The finished insole 14 includes a covering 42 secured over what would otherwise be exposed portions of the Texon 24, the top cushion 40, and the tuck 36 in the finished shoe. As shown in FIG. 10 , the insole covering 42 tracks the shape of and is slightly larger than the size of the Texon and top cushion outer profile 26. The covering is wrapped snugly around the edges of the Texon, top cushion and tuck, and glued or otherwise secured in position on the bottom side of the Texon and tuck (see e.g., FIG. 11). The insole covering is typically made from leather, imitation leather, fabric, or other suitable shoe-covering material to obtain the desired fashion and appearance in the finished shoe, and is relatively soft or flexible such that the weight of the wearer is transferred through the covering to the top cushion and the cushion insert 34. Thus, the finished insole is provided with the foot-shape profile of the shoe when viewed from above (as in FIG. 12) or from below (as in FIG. 11), with a toe end 14*a*, a heel end 14*b*, an outwardly projecting profile 14*c* corresponding to the position of the ball of the foot shape, an arch profile 14*d* corresponding to the position of the arch of the foot shape, and a forepart 14*e* established between the toe end 14*a* and the arch profile 14*d*. A soft heel seat 44 (FIG. 12), such as made from leather, imitation leather, fabric, etc., is optionally secured at the heel end to the top side of the insole covering. The forepart of the finished insole is shown in cross-section in FIG. 13.

The upper 12 of the sandal-type shoe 50 is an open upper with leather straps 22 for securing the shoe to the wearer's foot. Alternately, the upper can be provided with any convenient construction for the type or style of shoe desired, such as, but not limited to, a partially or substantially closed shoe or boot, and is made from any suitable material to obtain the desired fashion or appearance of the shoe. The outsole 18 and heel 20 are also of conventional or convenient construction. The outsole shown is made from durable leather, imitation leather or synthetic material with a standard outsole thickness, such as between approximately 1/16 to 1/8 inch thick for typical low profile casual shoes, dress shoes or high heel shoes. The high heel shown includes a conventional heel lift 20*a* at the lower end, and is covered or finished to visibly compliment the upper and insole of the shoe. Using more recent shoe construction techniques, the outsole and heel may be alternately provided as a single unit such as molded together from durable synthetic or composite material.

Figure 14:
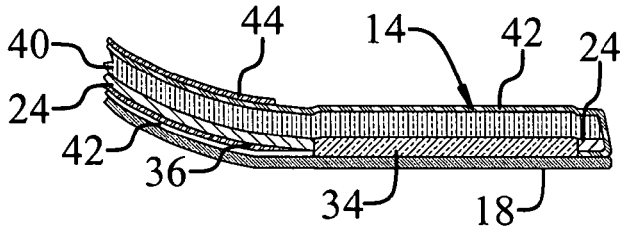
FIG. 14 is a cross-sectional view similar to FIG. 13 showing the forepart of a finished shoe.

The forepart of the finished shoe 50 is shown in cross-section in FIG. 14. The outsole 18 and finished insole 14 are glued or otherwise secured together with the cushion insert 34 sandwiched in position in the cutout 28 between the top cushion 40 and the outsole. The straps 22 are secured between or otherwise in fixed relation to the insole and outsole (see FIG. 15), and the heel is connected to or integrally formed with the heel end of the outsole.

With this arrangement, the bulk of the wearer's weight applied through the forepart of the foot is supported by the uniquely cushioned forepart of the insole 10, and in particular, by the cushion material comprising the top cushion and cushion insert of the insole, when ever the wearer's heel is raised, either while walking in a normal gait, or from the construction of the shoe with a high heel. Thus, the wearer obtains the benefit of full cushioned support along the entire insole, and through the entire thickness of the insole forepart. As previously noted, the preferred cushion insert is sized to over-fill the Texon cutout thickness in the insole. This results in slight upward pressure on and raising of the insole covering (see e.g., FIGS. 14-15) and/or compression of the insert when secured in position in the finished shoe, and provides the additional benefit of the raised top surface of the forepart of the top cushion compressing, preferably at most, to approximately the same level as the surrounding surface of the top cushion, even though the cushion insert supports substantially more weight than the surrounding top cushion, thereby reducing or eliminating formation of an uncomfortable depression in the forepart of the insole, particularly when worn for long periods of time.

Figure 13:
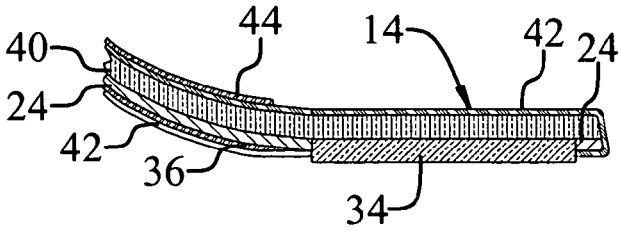
FIG. 13 is a fragmentary cross-sectional view of the forepart of the finished insole taken substantially along the line 13-13 of FIG. 12.
Figure 16:
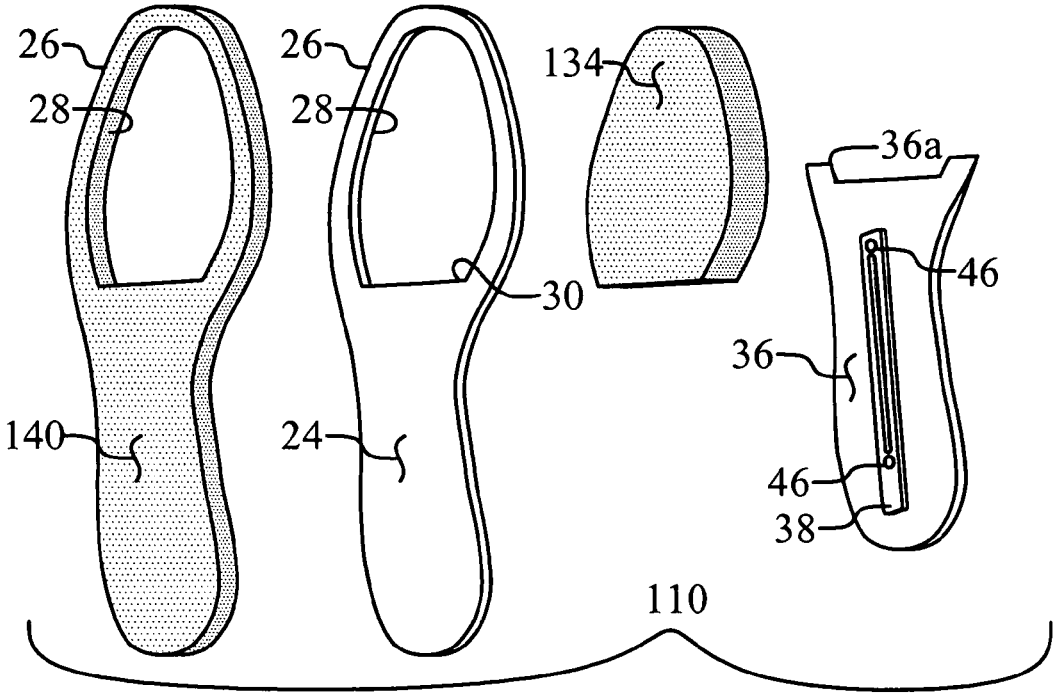
FIG. 16 is an exploded perspective view of a second embodiment cushioned insole incorporating alternate aspects of the invention.
Figure 17:
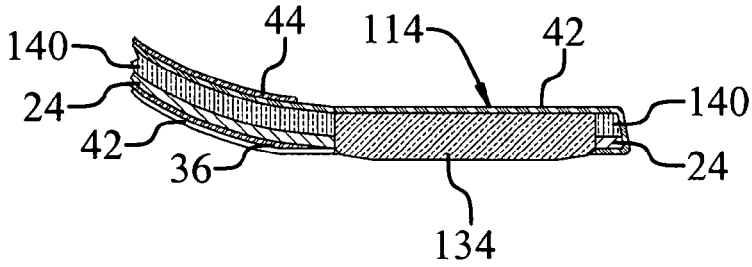
FIGS. 17 and 18 are fragmentary cross-sectional views similar to FIGS. 13 and 14 of the forepart of a finished insole and finished shoe utilizing the second embodiment cushioned insole.
Figure 18:
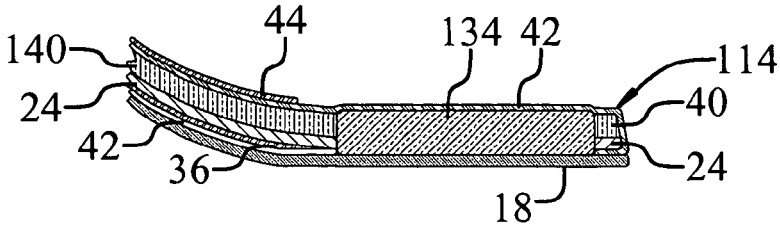

Referring to FIGS. 16-18, there is shown a second embodiment cushioned insole 110, and a corresponding finished insole 114. The cushioned insole 110 is similar to insole 10 except that the forepart cutout 28 is formed through both the top cushion 140 and the Texon layer 24, and the cutout is filled with a thicker cushion insert 134. Construction and components of the insole 110 that are identical to those of insole 10 are designated with the same reference numerals, and items that are similar to those of insole 10 are designated with the same reference numerals incremented to the 100 series. The thickness of the cushion insert 134 is established at least equal to the material thickness of the cutout 28 through the Texon 24 plus the material thickness of the top cushion 40 to completely fill the cutout in the insole, and as shown in FIG. 13, is preferably established with an additional thickness to overfill, for the reasons discussed above, the thickness of the cutout 28 through the top cushion and Texon. In the finished shoe (see FIG. 18), the insert 134 is secured in position in the cutout between the insole covering 42 and the outsole 18. All other aspects and use of the insole 110 are as described above in connection with insole 10. Accordingly, the alternate embodiment provides an alternate arrangement to establish the same cushioned insole support including cushioned support through the entire thickness of the insole forepart in the finished shoe.

Those skilled in the art will recognize and readily appreciate that insoles in accordance herewith may be provided in additional alternate embodiments. For example, the thickness of the top cushion and cushion insert may be increased from the preferred thickness specified above such as for use with thicker profile insoles and shoes, and/or alternate cushion materials may be used to obtain the desired cushioning characteristics.

Figure 19:
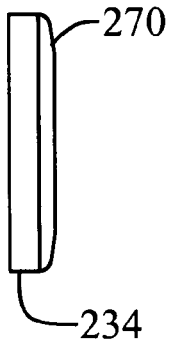
FIGS. 19 and 20 are side and bottom views of another alternate cushion insert.
Figure 20:
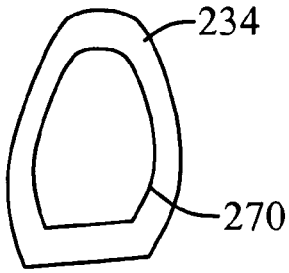
Figure 21:
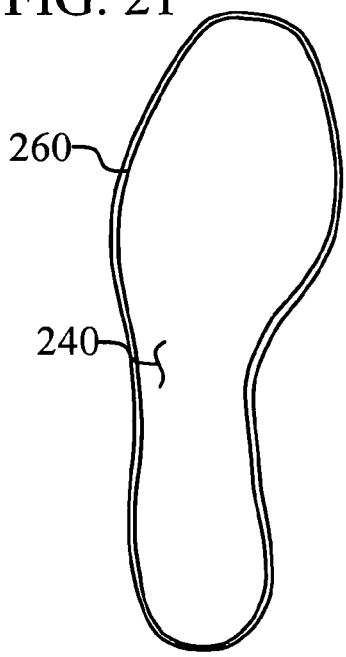
FIG. 21 is a top plan view of another alternate top cushion.

For further illustrative purposes, an alternate top cushion 240 (FIG. 21) is rounded, beveled or otherwise relieved along its top perimeter edge as indicated at 260 such as to approximately three-sixteenths inch inwardly. This bevel substantially eliminates visible edge-bulging effect that may otherwise occur with, for example, a top cushion and a non-supported or non-restricted straight outer edge when walking in the shoe, and is therefore particularly useful in shoes with a very flexible insole wrap such as thin fabric. In embodiments utilizing a thicker conventional leather of fabric insole covering sheet (or leather edge wrap), although the beveled top cushion may be utilized, the outer perimeter of the top cushion will typically be sufficiently restrained and naturally compressed along its upper surrounding edge and restricted such as shown in FIGS. 13-14, with the covering snugly wrapped around the forepart of the insole cushion, to substantially prevent visible outward bulging when walking in the shoe. Similarly, an alternate cushion insert 234 (FIGS. 19-20) can be provided with a rounded corner or bevel 270 along one or both outer edges. This relieved edge, if present, will provide a smoother compressive transition from the edges towards the center of the installed cushion insert, such as a smoother visible transition of the covering where slightly raised by the cushion insert shown in FIGS. 14 and 18.

Figure 22:
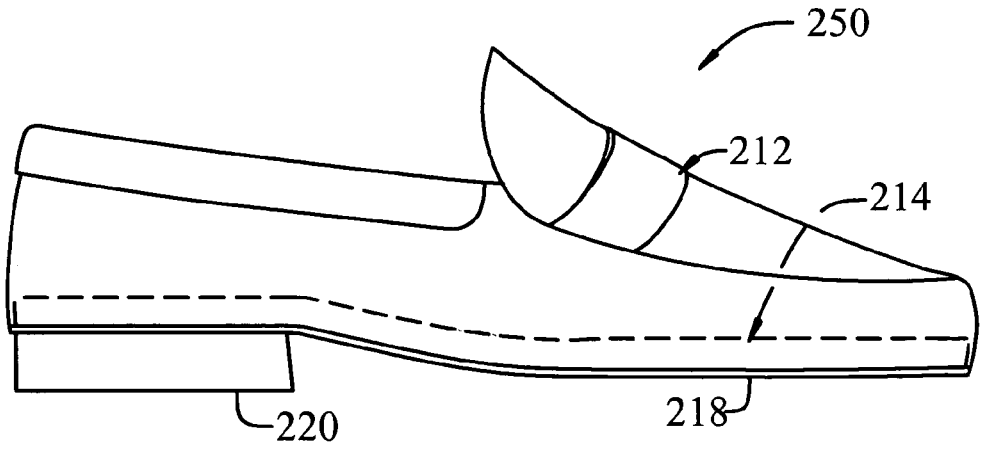
FIG. 22 is a side view of an alternate finished shoe utilizing a cushioned insole in accordance herewith.

As previously noted, the invention is suitable for use in other types of shoes such as, for example, shoes with an outsole and heel molded as a one-piece unit, shoes with partially or substantially closed uppers, shoes with "wedges" as heels, and high heel boots. Although the cushioned insole in accordance with the invention is uniquely capable of use in shoes that utilize a low profile insole, providing use and comfort advantages over similar-type shoes with prior insoles, use of the cushioned insole is not limited to use in such shoes. The cushioned insole may be utilized with a finished shoe constructed with a midsole of convenient construction and materials, or with other shoe parts, secured in position at the bottom of at least the forepart of the cushioned insole, between the insole and the outsole. As a further example, an alternate shoe 250 is shown in FIG. 22. This shoe includes a closed upper 212, an outsole 218, a heel 220, and a finished insole 214 with a cushioned insole as in cushioned insole 10 or 110 having a top cushion, a Texon support layer with an open forepart, a cushion insert that establishes cushioning through the forepart thickness thereof, and a shank and shoe tuck configured for the shoe shown.

From the foregoing, it will be apparent that the present invention brings to the art a new cushioned insole that is uniquely adapted for enhanced comfort, and to absorb the increased pressure at the front of the wearer's foot when the wearer's heel is raised from a high heel or while walking in a normal gait with a flat shoe and especially with high heel shoes, and thereby eliminating the discomfort associated with shoes utilizing prior insoles. In the preferred embodiments, cushioning through the entire thickness of the insole forepart, comprising at least the insole support layer and the top cushion layer, provides the maximum cushioning effect available in the insole forepart, and results in enhanced comfort when used in a finished shoe. Accordingly, the invention uniquely addresses disadvantages of prior insoles and prior shoes resulting from additional pressure that is often experienced at the front of the wearer's feet.

I claim:

1. A cushioned insole for use in a shoe, the shoe having an outsole and a forepart, the cushioned insole comprising:

a) an insole support layer having a top and a bottom, and having a foot-shape outer perimeter and profile with a forepart, a heel end, and an arch profile therebetween, the insole support layer further having a generally open forepart with a substantially surrounding perimeter and extending through the thickness thereof, b) a top cushion secured over the top of the insole support layer, the top cushion having the same outer perimeter and profile of the insole support layer to cover the entire insole support layer including the substantially surrounding perimeter of the generally open forepart of the insole support layer, c) a cushion insert over-filling the open forepart of the insole support layer, the thickness of the cushion insert being greater than the thickness of the insole support layer, the cushion insert establishing cushioning through and beyond the thickness of the top cushion and the insole support layer, and d) a flexible outer covering extending taught over the entire top cushion, the flexible outer covering wrapping snugly around the outer perimeter of the top cushion and insole support layer, the flexible outer covering being secured to the bottom of the insole; whereby the cushion insert extends above the top cushion and is compressively held between the flexible outer covering and the outsole of the shoe when the cushioned insole is used in said shoe.

2. The cushioned insole as defined in claim 1 in which said top cushion and said cushion insert are characterized with a compression deflection of approximately 25% with a compressive pressure of between approximately 2 to 12 psi applied thereto.

3. The cushioned insole as defined in claim 1 in which said top cushion and said cushion insert are provided entirely from foam rubber cushion material.

4. The cushioned insole as defined in claim 3 in which the top cushion extends over the open forepart of the insole support layer, and the cushion insert is secured against the bottom of the top cushion.

5. The cushioned insole as defined in claim 3 in which the top cushion further includes a generally open forepart extending through the thickness thereof, and the cushion insert fills the open foreparts of both the top cushion and the insole support layer.

6. The cushioned insole as defined in claim 1 in which the cushion insert is provided from one of an air-bubble cushion and a gel cushion.

7. The cushioned insole as defined in claim 1 in which the top cushion is, when in a relaxed, non-compressed condition, between approximately ⅛ inch to ¼ inch thick, the total forepart cushion thickness is, when in a relaxed, non-compressed condition, between approximately ¼ inch to ½ inch, the outsole is approximately 1/16 inch thick, and the forepart of the shoe is approximately ⅜ inch thick.

8. The cushioned insole as defined in claim 1 in which the top cushion is, when in a relaxed, non-compressed condition, approximately 3/16 inch thick, and the total forepart cushioned thickness is, when in a relaxed, non-compressed condition, is approximately ⅜ inch.

9. The cushioned insole as defined in claim 1 in which the generally open forepart of the insole support layer extends from proximate the forepart perimeter to the arch profile and substantially across the width thereof.

10. The cushioned insole as defined in claim 1 in which the entire insole support layer is at least approximately 3/32 inch thick.

11. A high heel shoe comprising:

a) a cushioned insole having a foot-shape outer profile with a forepart, a heel end, and an arch profile therebetween, b) an outsole secured in fixed relation to and located below the cushioned insole;

c) an upper secured in fixed relation to and located generally above the insole; and d) a high heel secured below the heel end of the cushioned insole, the heel being sized to raise the heel end of the cushioned insole to a height of at least one inch above the forepart of the cushioned insole;

e) the cushioned insole comprising:

i) an insole support layer with a top, a bottom, an outer perimeter and said outer profile, and with a generally open forepart having a surrounding perimeter and extending through the thickness thereof, ii) a top cushion secured over the insole support layer, the top cushion having the same outer perimeter of the insole support layer to cover the entire insole support layer including the substantially surrounding perimeter of the generally open forepart of the insole support layer, iii) a flexible insole covering extending taught over the entire top cushion, the flexible outer covering wrapping snugly around the outer perimeter of the top cushion and insole support layer, the flexible outer covering being secured to the bottom of the insole, and iv) a cushion insert over-filling the open forepart of the insole support layer, the thickness of the cushion insert being greater than the thickness of the insole support layer, the cushion insert establishing cushioning through and the thickness of the insole between the insole covering and the outso1e; whereby the cushion insert extends above the top cushion and is compressively held between the flexible outer covering and the outsole.

12. The high heel shoe as defined in claim 11 in which the high heel is sized to raise the heel end of the cushioned insole to a height of at least one and one-half inches above the forepart of the cushioned insole.

13. The high heel shoe as defined in claim 11 in which said top cushion and said cushion insert are characterized with a compression deflection of approximately 25% with a compressive pressure of between approximately 2 to 12 psi applied thereto.

14. The high heel shoe as defined in claim 11 in which said top cushion and said cushion insert are provided entirely from foam rubber cushion material.

15. The high heel shoe as defined in claim 11 in which the top cushion extends over the open forepart of the insole support layer, and the cushion insert is secured between the top cushion and the outsole.

16. The high heel shoe as defined in claim 11 in which the top cushion further includes a generally open forepart extending through the thickness thereof, and the cushion insert fills the open foreparts of both the top cushion and the insole support layer.

17. The high heel shoe as defined in claim 11 in which the cushion insert is provided from one of an air-bubble cushion and a gel cushion.

18. The high heel shoe as defined in claim 11 in which the top cushion is, when in a relaxed, non-compressed condition, between approximately ⅛ inch to ¼ inch thick, the total forepart cushion thickness is, when in a relaxed, non-compressed condition, between approximately ¼ inch to ½ inch, the outsole is approximately 1/16 inch thick, and the forepart of the shoe is approximately ⅜ inch thick.

19. The high heel shoe as defined in claim 11 in which the top cushion is, when in a relaxed, non-compressed condition, approximately 3/16 inch thick, and the total forepart cushioned thickness is, when in a relaxed, non-compressed condition, is approximately ⅜ inch.

20. The cushioned insole as defined in claim 11 in which the entire insole support layer is at least approximately 3/32 inch thick.

21. A method for manufacturing a shoe comprising:

a) providing a cushioned insole having a foot-shape outer profile with a forepart, a heel end, and an arch profile therebetween, the cushioned insole comprising:

i) an insole support layer with a top, a bottom, an outer perimeter and said outer profile, and with a substantially open forepart having a generally surrounding perimeter and extending through the thickness thereof, ii) a top cushion secured over the insole support layer, the top cushion having the same outer perimeter of the insole support layer to cover the entire insole support layer including the substantially surrounding perimeter of the generally open forepart of the insole support layer, and iii) a cushion insert over-filling the open forepart of the insole support layer, the thickness of the cushion insert being greater than the thickness of the insole support layer, the cushion insert establishing cushioning through the entire thickness of the top cushion and insole support layer;

b) securing:

i) a flexible insole covering taught over the entire top cushion including snugly wrapping flexible outer covering around the outer perimeter of the top cushion and insole support layer and securing the flexible outer covering to the bottom of the insole support layer, ii) an upper in fixed relation to and generally above the insole, and iii) one of an outsole or a midsole to the bottom of the cushioned insole, whereby the cushion insert extends above the top cushion and is compressively held between the flexible insole covering and said one of the outsole and midsole.

22. The method for manufacturing a shoe as defined in claim 21 in which said top cushion and said cushion insert are characterized with a compression deflection of approximately 25% with a compressive pressure of between approximately 2 to 12 psi applied thereto.

23. The method for manufacturing a shoe as defined in claim 21 in which said top cushion and said cushion insert are provided entirely from foam rubber cushion material.

24. The method for manufacturing a shoe as defined in claim 21 in which the top cushion extends over the open forepart of the insole support layer, and the cushion insert is secured between the top cushion and said one of the outsole and midsole.

25. The method for manufacturing a shoe as defined in claim 21 in which the top cushion further includes a generally open forepart extending through the thickness thereof, and the cushion insert fills the open foreparts of both the top cushion and the insole support layer.

26. The method for manufacturing a shoe as defined in claim 21 in which the cushion insert is provided from one of an air-bubble cushion and a gel cushion.

27. The method for manufacturing a shoe as defined in claim 21 in which the top cushion is, when in a relaxed, non-compressed condition, between approximately ⅛ inch to ¼ inch thick, the total forepart cushion thickness is, when in a relaxed, non-compressed condition, between approximately ¼ inch to ½ inch, the outsole is approximately 1/16 inch thick, and the forepart of the shoe is approximately ⅜ inch thick.

28. The method for manufacturing a shoe as defined in claim 21 in which the top cushion is, when in a relaxed, non-compressed condition, approximately 3/16 inch thick, and the total forepart cushioned thickness is, when in a relaxed, non-compressed condition, is approximately ⅜ inch.

29. The cushioned insole as defined in claim 21 in which the entire insole support layer is at least approximately 3/32 inch thick.

* * * * *